US007208673B2

(12) United States Patent
Bryce

(10) Patent No.: US 7,208,673 B2
(45) Date of Patent: Apr. 24, 2007

(54) BI-DIRECTIONAL SWITCH APPARATUS WITH ELECTRIC GUITAR APPLICATIONS

(76) Inventor: Alasdair James Bryce, 74 Branksome Drive, Bradford, West Yorkshire (GB) BD18 4BE ( * ) Notice: Subject to any disclaimer, the term of this patent is extended or adjusted under 35 U.S.C. 154(b) by 180 days.

(21) Appl. No.: 10/912,693

(22) Filed: Aug. 6, 2004

(65) Prior Publication Data

US 2005/0087063 A1 Apr. 28, 2005

(30) Foreign Application Priority Data

Oct. 28, 2003 (GB) ..... 0325103

(51) Int. Cl.
*G10H 1/18* (2006.01)
*G10H 3/12* (2006.01)

(52) U.S. Cl. ..... 84/742; 84/726; 84/728; 84/736

(58) Field of Classification Search ..... 84/299, 84/313, 737, 727, 723, 742, 736, 741, 423, 84/728, 726

See application file for complete search history.

(56) References Cited

U.S. PATENT DOCUMENTS

| | | | | |
|---|---|---|---|---|
| 4,305,320 A | | 12/1981 | Peavey | |
| 4,481,854 A | * | 11/1984 | Dugas | 84/736 |
| 4,711,149 A | | 12/1987 | Starr | |
| 5,136,918 A | * | 8/1992 | Riboloff | 84/723 |
| 5,136,919 A | * | 8/1992 | Wolstein | 84/742 |
| 5,763,808 A | * | 6/1998 | Thomson | 74/728 |
| 5,780,760 A | * | 7/1998 | Riboloff | 84/726 |
| 6,121,537 A | * | 9/2000 | Pawar et al. | 84/728 |
| 6,998,529 B2 | * | 2/2006 | Wnorowski | 84/726 |

* cited by examiner

*Primary Examiner*—Lincoln Donovan
*Assistant Examiner*—Christina Russell

(57) ABSTRACT

A selector switch for musical instruments, such as electric guitars. is provided having a single, manually operated toggle member adapted to perform greater functionality. A selector switch is disclosed which indexes longitudinally for the electrical connection of pickup(s) for resultant amplification but will additionally provide further associated connectivity by means of a transverse indexing motion thus availing expanded switching function from a single switch apparatus. This inventive step is referred to as a compound selector switch.

6 Claims, 10 Drawing Sheets

BI-DIRECTIONAL SWITCH APPARATUS WITH ELECTRIC GUITAR APPLICATIONS

CROSS-REFERENCE TO OTHER RELATED APPLICATIONS

This application relates to and claims priority from GB Patent Application Number GB 0325103, filed on Oct. 28, 2003, disclosure of which is incorporated herein by reference.

BACKGROUND OF THE INVENTION

1. Field of the Invention

This invention relates to pickup switching apparatus for electric guitars, of any type, having more than one pickup. Electric guitar players prefer to selectively use: pickup(s); pickup configuration; additional electrical circuitry and types of amplification in different combinations so as to produce those tonal qualities suitable to the varying playing styles which they favour. Changing between such tonalities may be a frequent requirement and can involve multiple switch operation.

On a two pickup guitar, a conventional three-position toggle switch is the primary means of selection and will connect either pickup alone at it's extreme index positions, or both pickups in parallel in it's central index position for resultant amplification. This switch element is now a long-established feature of electric guitars.

On a three pickup guitar, a conventional five-position switch is the primary means of selection and will connect bridge pickup alone, bridge and middle pickups in parallel, middle pickup alone, middle and neck pickups in parallel, and neck pickup alone for resultant amplification in respective index positions. This switch element is now also a long-established feature of electric guitars.

2. Description of the Related Art

Other types of switches have been known in the prior art, for example multi-indexing rotary controls have also been used for pickup selection but are generally regarded as inferior in this application in that they offer poor visual representation of their settings and in that their operation is less intuitive than the aforementioned three-position or five-position selector switches.

Guitars which offer a wider range of electrical configuration options may incorporate a variety of switches and additional circuitry. Typically, these may include: three or five-position selector switches; separate toggle switch(es); push-button switch(es); slider switch(es); multi-indexing rotary switches; or, push/pull or push/push switching enacted from associated potentiometer apparatus, or combinations thereof.

As an example, it is known that various guitars have been designed to offer a combination of the tonalities generally associated with formative manufacturers Gibson and Fender. Such guitars generally employ dual-coil bridge pickup, single-coil middle pickup, and dual-coil neck pickup. In this format, dual-coil bridge and neck pickups are selectively used to approximate the 'Gibson' tonalities, whereas, a single coil of each of the dual-coil bridge and neck pickups are selectively used with the single-coil middle pickup to approximate the 'Fender' tonalities. Such a system is disclosed in U.S. Pat. No. 5,136,918 of August, 1992 to Riboloff, where the function of a five-position selector switch varies dependant upon a secondary switch element so as to provide 'Gibson' and 'Fender' modes of operation.

Although offering expanded functionality, such switching arrangements may be confusing and slow to operate in that it is necessary to recognise the settings on more than one switch and then to change the settings on more than one switch whilst maintaining concentration on the musical performance. Such arrangements may also exhibit an unfamiliar progression of settings upon indexing the selector switch, or may introduce an excessive level of diversity where the differences between some settings are practically indiscernible. Ultimately, they may lack a clarity of function which would be essential for any widespread acceptance.

U.S. Pat. No. 4,481,854 A of November 1984 to Dugas discloses the use of a joystick to simultaneously vary dual potentiometer settings on an electric guitar. The joystick device is clearly capable of generating an infinite scope of variations, although, many users would arguably prefer a lesser quantity of clearly defined settings which can be repeatably achieved. Being a potentiometer device rather than a switch device, the functionality is not intended to be electrically compatible with typical switch functions as known in the art, nor can it function passively. Further, the absence of any indexing action means: that any adjustment to the actuator must always be discretionary, and; that the feel of the control will be unfamiliar and comparitively difficult to judge.

Ultimately, the use of three-position and five-position pickup selector switches has become part of the skill of the guitar player and is familiar to those players.

BRIEF SUMMARY OF THE INVENTION

It is the object of this invention: to provide expanded selector switching functionality from a single switch member thus providing a simplified, comprehensive and rapidly operable control for the guitarist; to provide selector switching which is familiar to the guitarist and can be used intuitively by virtue of it's visual and tactile qualities; to provide selector switching which may be integrated harmoniously within a range of different guitar models, and; to provide selector switching which may be manufactured and installed economically and be compatible with various types of pickup and associated equipment, in order that it may find widespread application.

To achieve the foregoing objects, the present invention provides for typically three-position and five-position pickup selector switches whereupon the toggle members index longitudinally in the conventional manner but also index transversely so as to avail parallel index positions whereupon additional electrical switching is enacted so as to provide enhanced functionality. This inventive concept will be hereafter referred to as a compound selector switch.

It will be shown that such compound selector switches may exist in a number of embodiments and can be used in a wide range of applications. In all instances, however, compound selector switches provide guitarists with a single control element which may operatively replace the combinations of discrete switches used on conventional guitars and may afford concurrent control of their functionality.

DETAIL DESCRIPTION OF THE INVENTION

Compound selector switches may exist in a variety of forms and two main embodiments are described herein. Embodiment 'A' manifests a compound version of a typical three-position selector switch and is illustrated and described in FIG. 1 through FIG. 11. Embodiment 'B' manifests a compound version of a typical five-position selector switch and is illustrated and described in FIG. 12 through FIG. 24.

Figure 1:
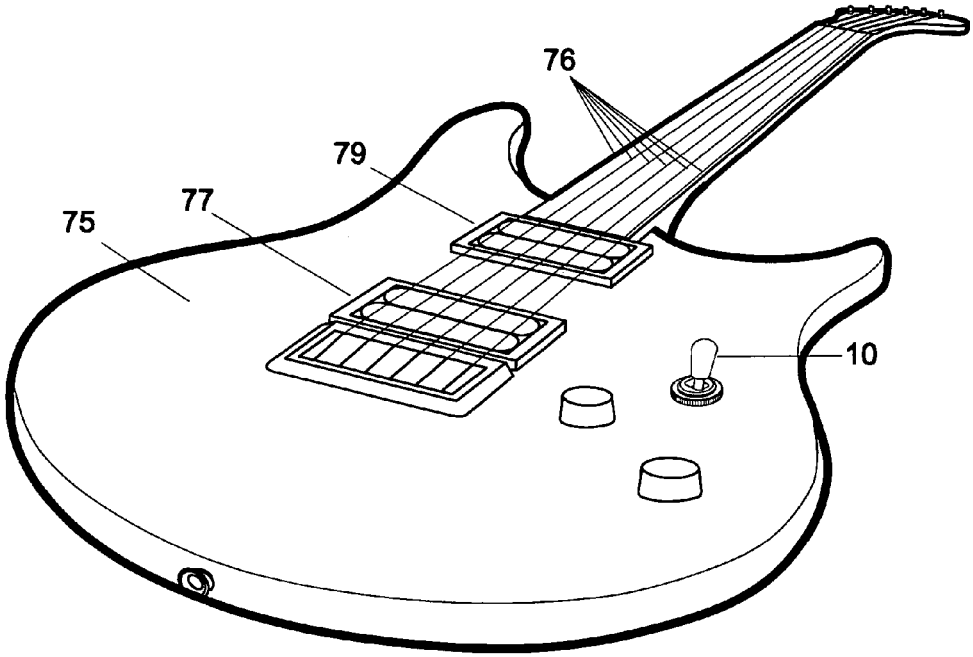
FIG. 1 is a perspective view of a generic two pickup electric guitar showing the embodiment 'A' compound selector switch mounted therein.

In respect of embodiment 'A', FIG. 1 illustrates a stringed instrument of the electric guitar type wherein a plurality of strings 76 are anchored and tensioned in such a way that their vibration interacts with bridge pickup 77 and neck pickup 79 which are also mounted on guitar body 75. Mounted internally within the guitar but with outwardly protruding toggle member 10, the compound selector switch is positioned so as to be manually operable by the player.

Figure 2:
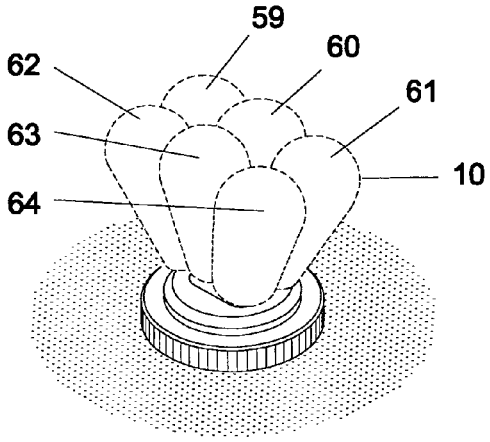
FIG. 2 is an enlarged detail view taken from FIG. 1 illustrating the indexing array.

FIG. 2 shows an enlarged view of said outwardly protruding toggle member 10 and illustrates the various index positions (59 through 64 inclusive) available in operation.

Figure 3:
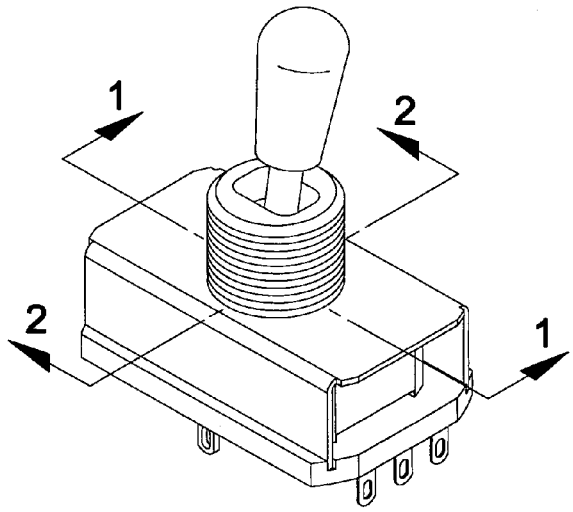
FIG. 3 is a perspective view of the embodiment 'A' compound selector switch shown in isolation from the guitar.

FIG. 3 shows a view of the assembled embodiment 'A' compound selector switch and references section lines '1—1' and '2—2'.

Figure 4:
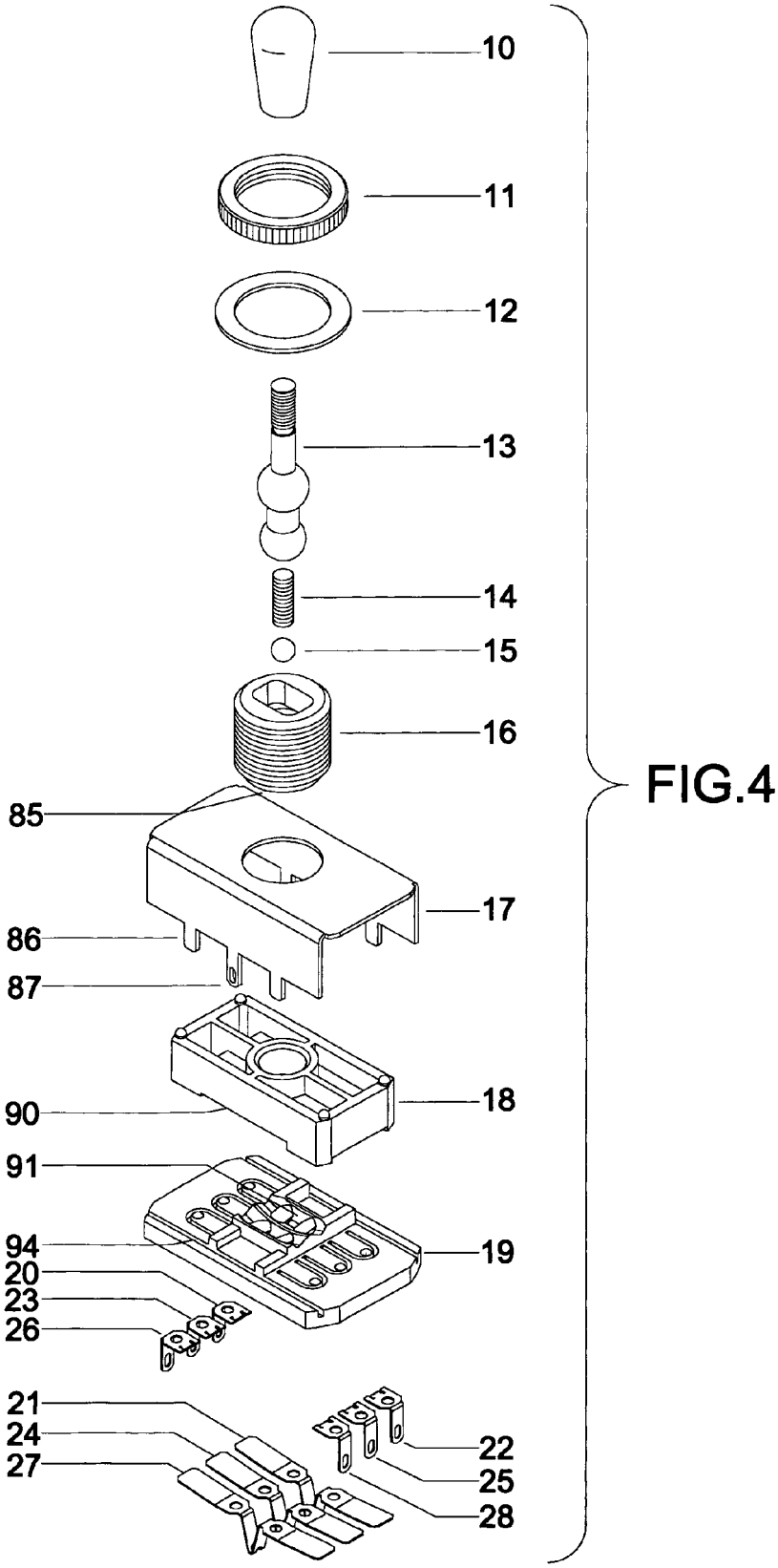
FIG. 4 is an exploded view of the embodiment 'A' compound selector switch which illustrates all the component parts.

With reference to FIG. 4, Toggle member 10 is a plastic moulded cap which attaches by screw-thread means to lever 13 which is a machined steel component. Threaded collar 16 is a machined steel component which attaches, by swaging flange 85 to casing 17 which is a press-formed steel component. Actuator moulding 18 and detent moulding 19 are both injection moulded plastic components of a suitably resilient material such as polypropylene. Electrical contacts 20 through 28 are of a material customarily used in such applications such as Phosphor Bronze and may be treated with surface platings. Compression spring 14 applies pressure onto steel ball 15 which then engages upon the detent form 91 of detent moulding 19. The assembly is completed by locating tabs 86 of casing 17 into corresponding slots & apertures 94 of detent moulding 19 and folding them inwards to secure. Tabs 87 of casing 17 are not folded and thus act as ground terminations for subsequent wiring. Fitting of the completed compound selector switch requires that threaded collar 16 should be located into a corresponding hole in the guitar body and then secured with ring nut 11 above washer 12. Contact groups 20+21+22, 23+24+25, and 26+27+28 effectively form three single-pole, double-throw switches whose electrical function, relative to the indexing action of lever 13, is governed by the underside profiling 90 of actuator moulding 18.

Figure 5:
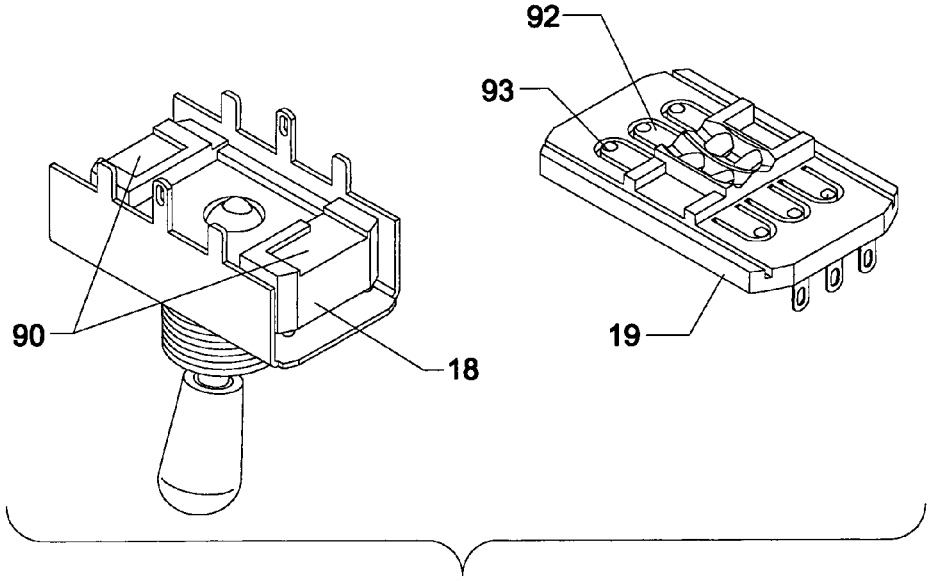
FIG. 5 is a partially exploded view of the embodiment 'A' compound selector switch which illustrates an internal relationship of the component parts.

With reference to FIG. 5 detent moulding 19 is adapted with six flexible tongues 92 which are outwardly displaceable by means of raised bosses 93 which engage selectively with the underside profiling 90 of actuator moulding 18.

Figure 6:
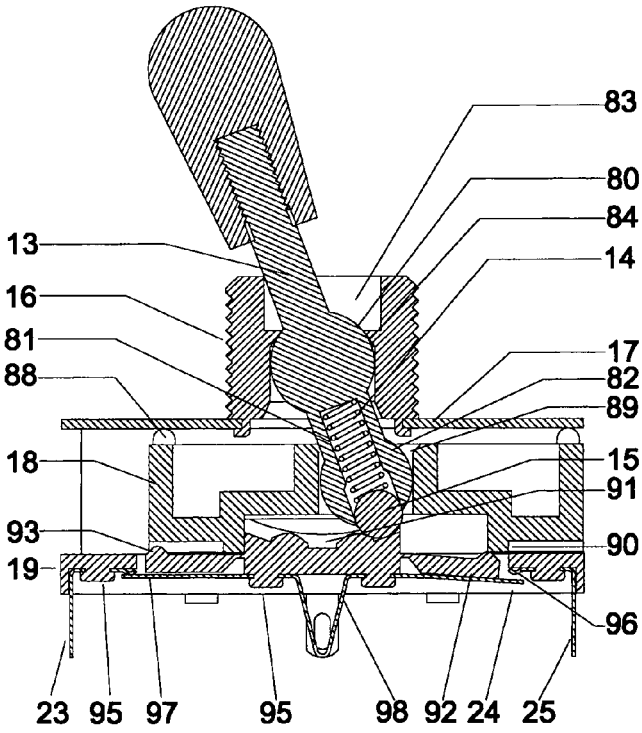
FIG. 6 is a sectional view taken on line 1—1 of the embodiment 'A' compound selector switch.

With reference to FIG. 6, lever 13 is adapted with ball form 80 which engages into cavity 84 of threaded collar 16 thus defining a relative pivotal freedom of movement. This pivotal movement is limited by aperture 83 of threaded collar 16 upon which lever 13 engages at the extremes of it's travel. Lever 13 is further adapted with a concentric hole 81 which houses compression spring 14 and steel ball 15. As lever 13 is manually displaced, steel ball 15 engages into detent form 91 of detent moulding 19 so as to define the specific index positions. Lever 13 is further adapted with ball form 82 which engages into a hole 89 of actuator moulding 18. Actuator moulding 18 is enclosed within the assembly by casing 17 and detent moulding 19, and reacts to the displacement of lever 13 in a longitudinal and lateral sliding motion. Actuator moulding 18 has four bosses 88 which locate internally upon casing 17 and a profiled underside 90 which engages on the surface of detent moulding 19. Detent moulding 19 is adapted to it's outer face with a series of protrusions 95 to which contacts 23 through 25 are attached by means of heat peening. Outer contacts 23 and 25 are adapted with raised contact points 96 to their inner ends, whereas the outer ends are adapted for solder termination. Centre contact 24 is adapted with upwardly biased ends 97 such that, when assembled, they apply a positive connection force to the raised contact points 96 of the outer contacts. Centre contact 24 is further adapted with a 'V' form 98 to accommodate solder termination. Where the underside profile 90 of actuator moulding 18 displaces tongues 92 by means of raised bosses 93, electrical contact between centre and outer contacts is broken.

Figure 7:
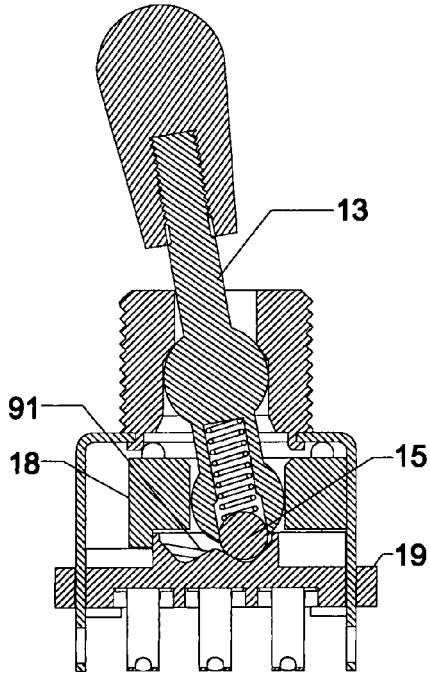
FIG. 7 is a sectional view taken on line 2—2 of the embodiment 'A' compound selector switch.

FIG. 7 shows how transverse displacement of lever 13 moves steel ball 15 over detent form 91 of detent moulding 19 and causes a corresponding displacement of actuator moulding 18.

FIG. 8 through FIG. 11 illustrate the preferred electrical function, relative to each index position, of the embodiment 'A' compound selector switch and also demonstrate a variety of functions.

Figure 8:
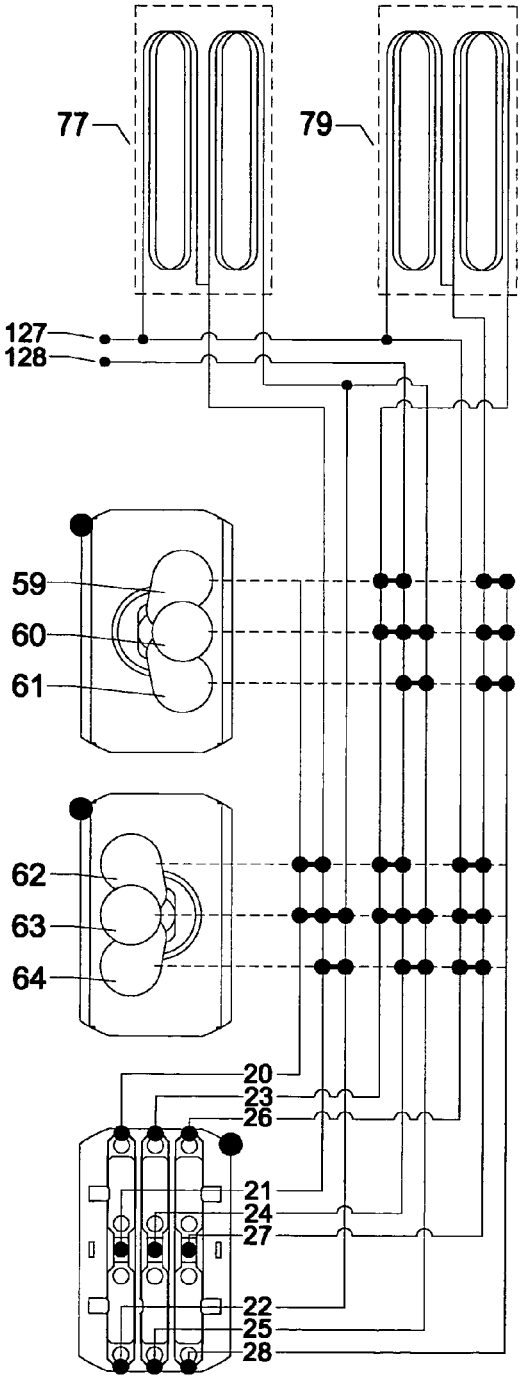
FIG. 8 is a schematic circuit diagram demonstrating a first application of the embodiment 'A' compound selector switch.

FIG. 8 illustrates how the outputs of pickups 77 and 79 are selectively connected to output pairing 127+128 to provide the customary pickup settings in positions 59 through 61. These settings are also exhibited in positions 62 through 64 at which the 'inner' coils of pickups 77 and 79 are disabled via the connections at 21+22 and 26+27 respectively. This effectively performs an integrated 'coil-tap' function normally effected from discrete switching. Contacts 20, 23, 24, 25 and 28 are shown for reference purposes.

Figure 9:
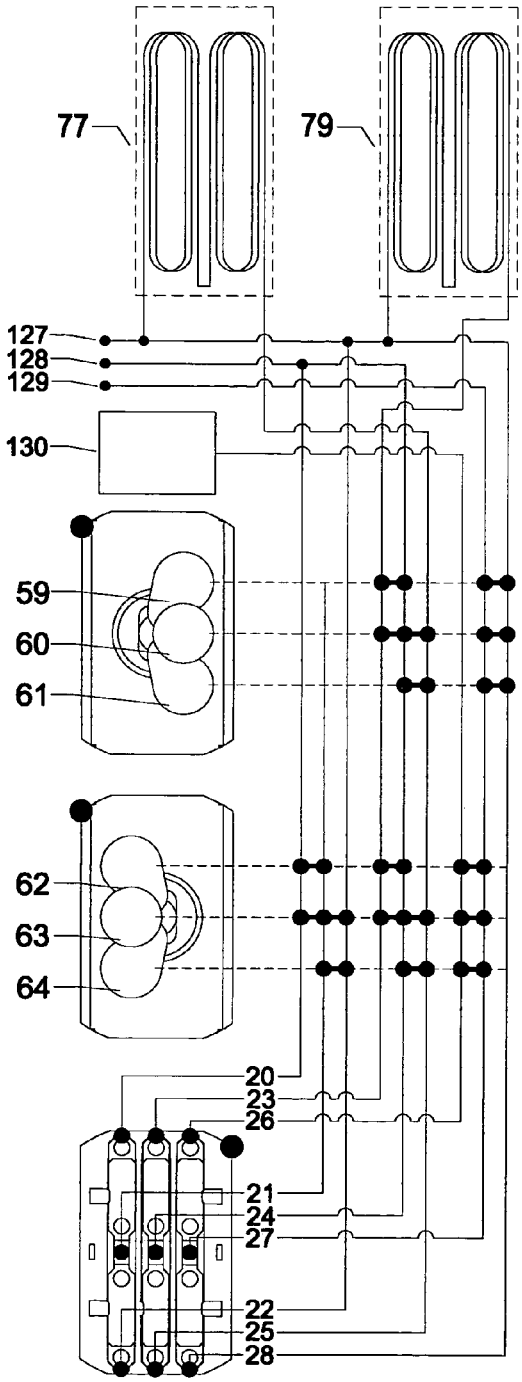
FIG. 9 is a schematic circuit diagram demonstrating a second application of the embodiment 'A' compound selector switch.

FIG. 9 illustrates how the outputs of pickups 77 and 79 are selectively connected to output pairing 127+128 to provide the customary pickup settings in positions 59 through 61. Positions 62 through 64 connect the output of piezo pickup source 130 to output pairing 127+129 via the connections at 26+27. Positions 62 and 64 connect neck pickup 79 and bridge pickup 77 to output pairing 127+128 respectively. Position 63 connects output 128 to ground at 127 via the connection path 20+22. This effectively provides an integrated 'magnetic/magnetic+piezo/piezo' function normally effected from discrete switching. Contacts 21, 23, 24, 25 and 28 are shown for reference purposes.

Figure 10:
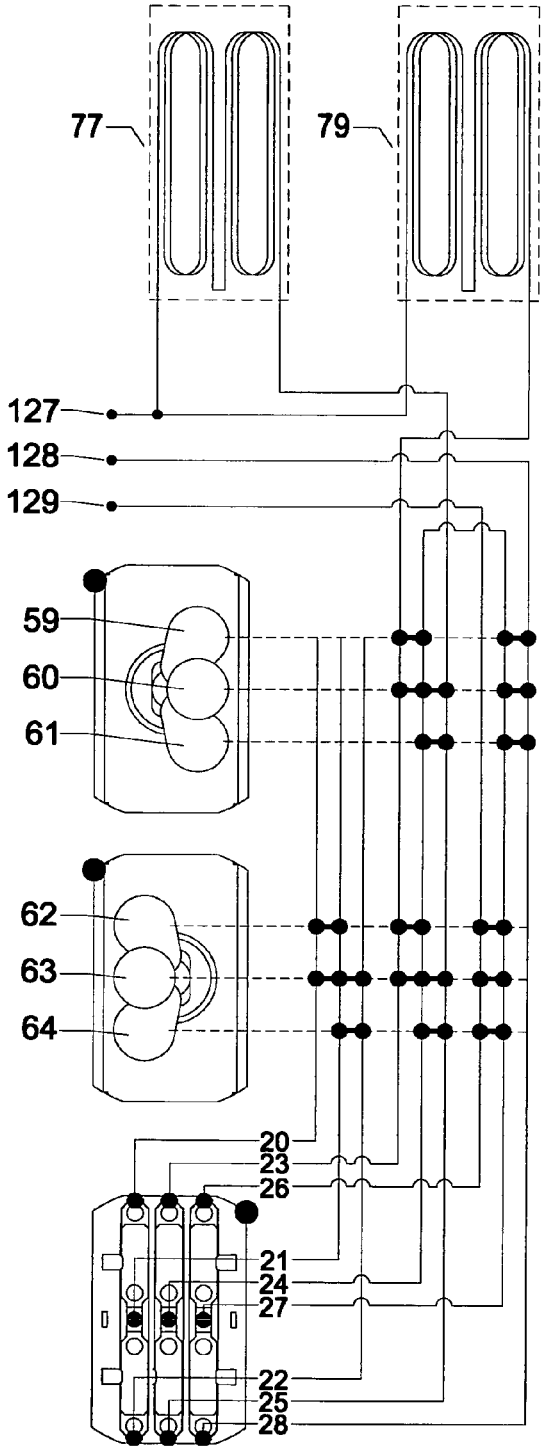
FIG. 10 is a schematic circuit diagram demonstrating a third application of the embodiment 'A' compound selector switch.

FIG. 10 illustrates how the outputs of pickups 77 and 79 are selectively connected to output pairing 127+128 in positions 59 through 61 via the connections 27+28. In positions 62 through 64, the same pickup selections are connected to output pairing 127+129 via the connections 26+27. When terminals 127+128+129 are connected, via a stereo jack socket and lead, to alternative amplification and/or processing equipment, this arrangement effectively provides integrated pickup and dual channel selection normally effected from discrete switching. Contacts 20, 21, 22, 23, 24 and 25 are shown for reference purposes.

Figure 11:
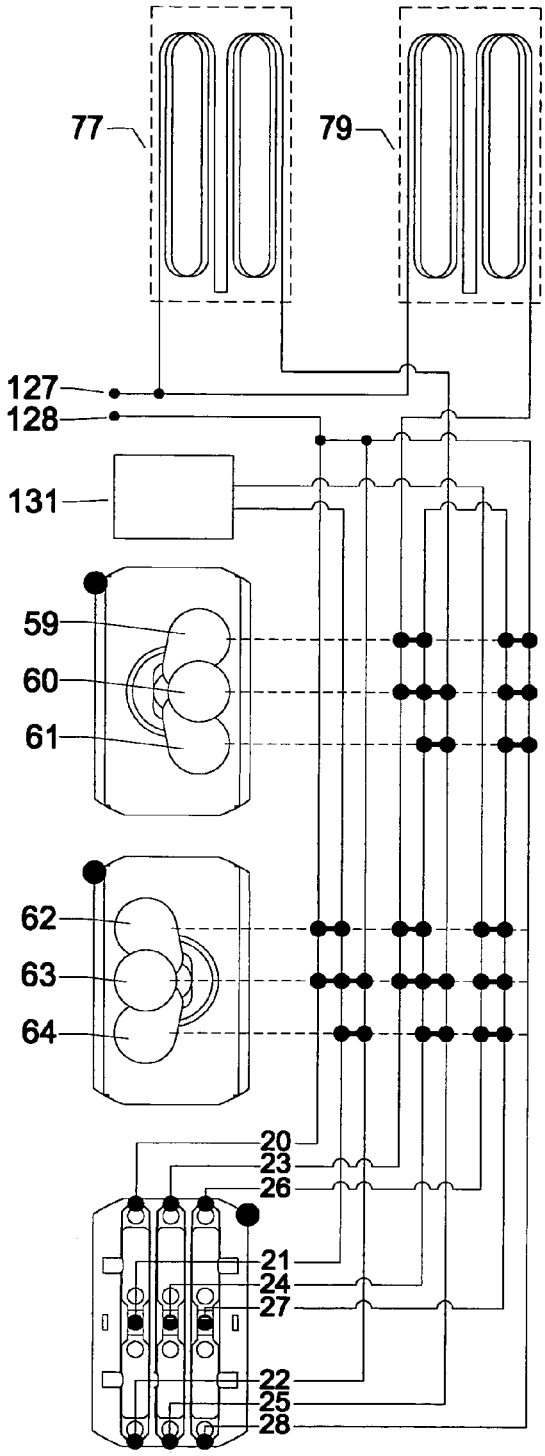
FIG. 11 is a schematic circuit diagram demonstrating a fourth application of the embodiment 'A' compound selector switch.

FIG. 11 illustrates how the outputs of pickups 77 and 79 are selectively connected to output pairing 127+128 via the connections 27+28 thus providing the customary pickup settings in positions 59 through 61. These settings are also exhibited in positions 62 through 64 at which additional circuit element 131 is introduced to the output path via the connections 26+27 and 20+21+22. Additional circuit element 131 may be a preamplifier, tone control or effects device such as are customarily used. This effectively provides integrated control of additional circuit elements normally effected from discrete switching. Contacts 23, 24 and 25 are shown for reference purposes.

Figure 12:
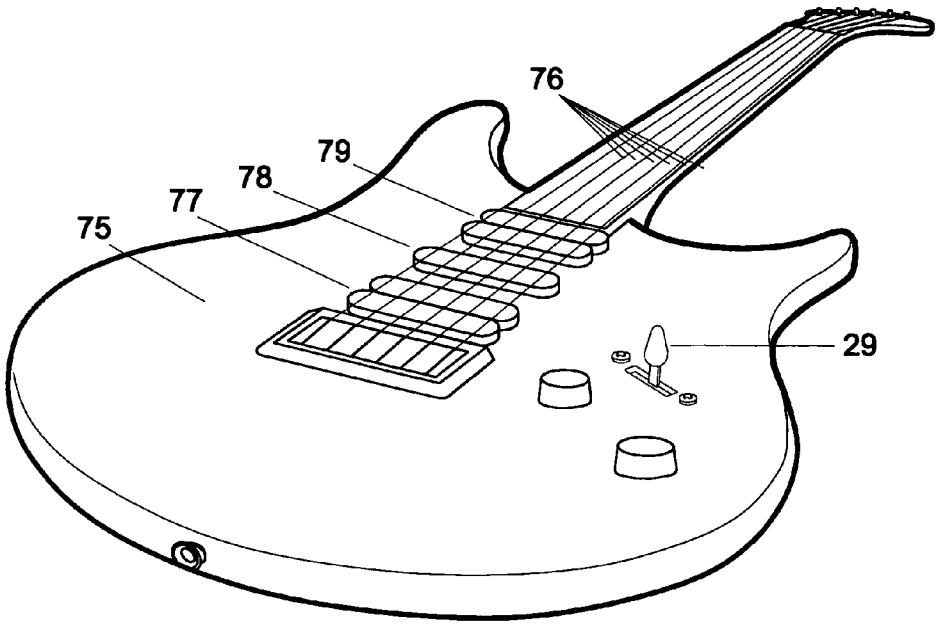
FIG. 12 is a perspective view of a generic three pickup electric guitar showing the embodiment 'B' compound selector switch mounted therein.

In respect of embodiment 'B', FIG. 12 illustrates a stringed instrument of the electric guitar type wherein a plurality of strings 76 are anchored and tensioned in such a way that their vibration interacts with bridge pickup 77, middle pickup 78, and neck pickup 79 which are also mounted on the guitar body 75. Mounted internally within the guitar but with outwardly protruding toggle member 29, the compound selector switch is positioned so as to be manually operable by the player.

Figure 13:
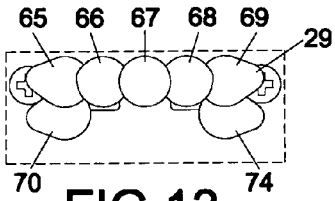
FIG. 13 is a plan view upon the embodiment 'B' compound selector switch illustrating a first example of the indexing array.

FIG. 13 shows a plan view of said outwardly protruding toggle member 29 and illustrates a configuration where linear progression 65, 66, 67, 68 & 69 is augmented by two additional specific positions 70 and 74.

Figure 14:
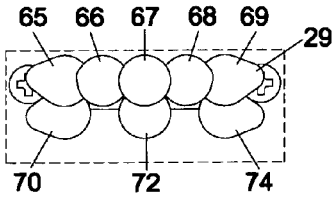
FIG. 14 is a plan view upon the embodiment 'B' compound selector switch illustrating a second example of the indexing array.

FIG. 14 shows a plan view of said outwardly protruding toggle member 29 and illustrates a configuration where linear progression 65, 66, 67, 68 & 69 is set parallel to dissimilar linear progression 70, 72 & 74.

Figure 15:
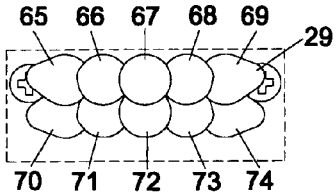
FIG. 15 is a plan view upon the embodiment 'B' compound selector switch illustrating a third example of the indexing array.

FIG. 15 shows a plan view of said outwardly protruding toggle member 29 and illustrates a configuration where linear progression 65, 66, 67, 68 & 69 is set parallel to similar linear progression 70, 71, 72, 73 & 74.

Figure 16:
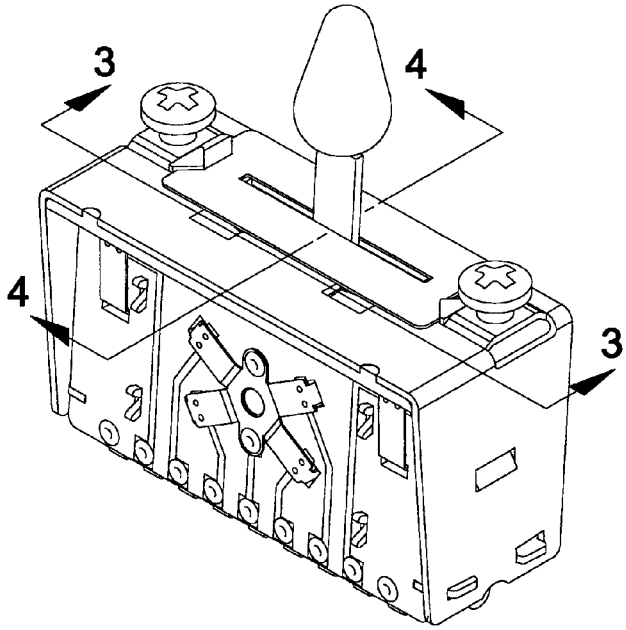
FIG. 16 is a perspective view of the embodiment 'B' compound selector switch shown in isolation from the guitar.

FIG. 16 shows a view of the assembled embodiment 'B' compound selector switch and references section lines '3—3' and '4—4'.

Figure 17:
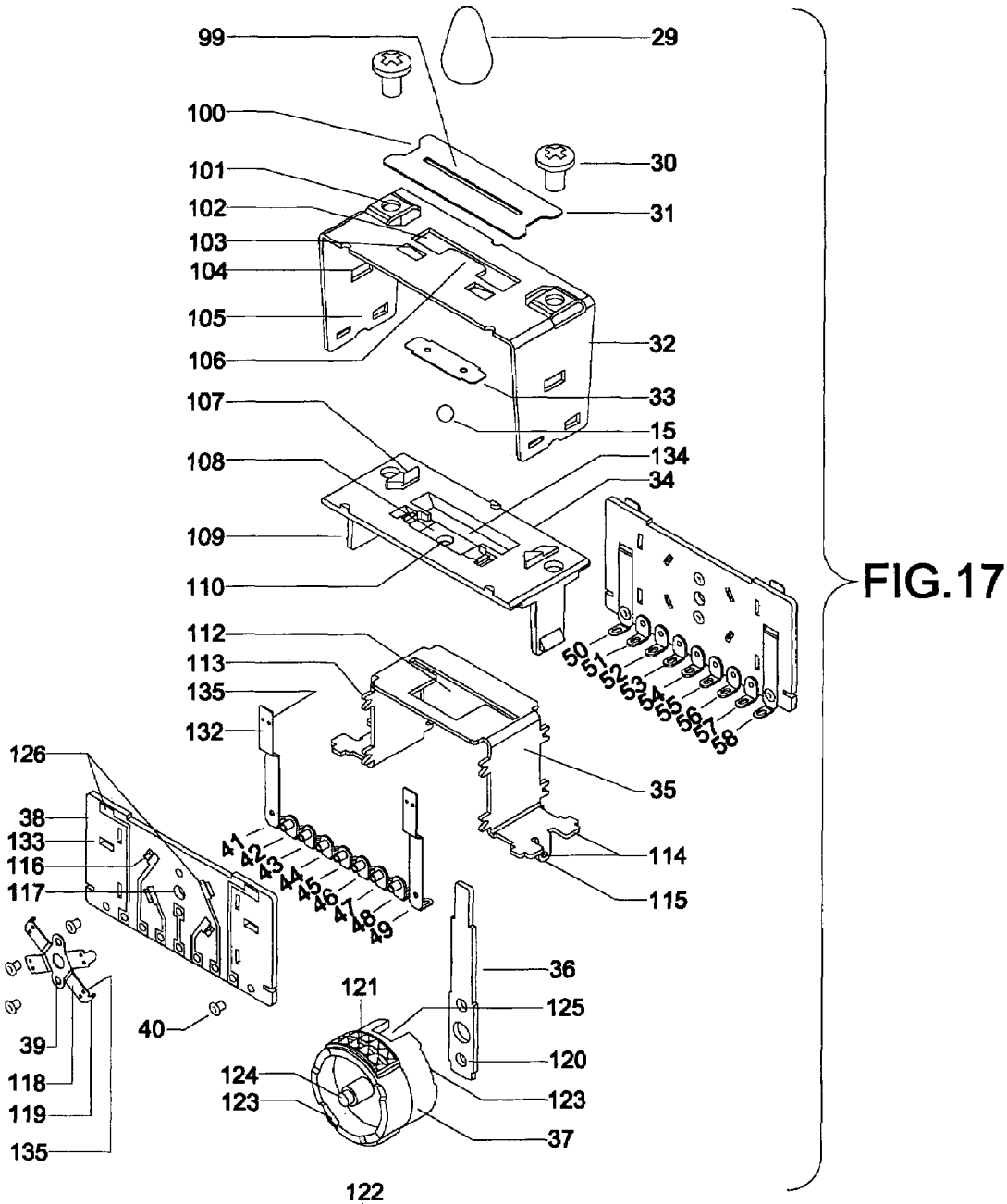
FIG. 17 is an exploded view of the embodiment 'B' compound selector switch which illustrates all the component parts.

With reference to FIG. 17, toggle member 29 is a plastic moulded cap which attaches by push-fit means to lever 36 which is a stamped steel component, adapted with holes 120 so that it may be attached, by means of heat peening, to rotary detent moulding 37 by location within rebate 125. Housing 32 is a pressed steel component to which top moulding 34 attaches by means of location of legs 109 into cut-outs 104. Flat spring 33, of a resilient steel material, locates into corresponding rebate area 108 of top moulding 34 such that when assembled it's ends engage on tabs 103. Top moulding 34 is adapted with hole 110 to receive steel ball 15 such that it then engages centrally on flat spring 33. Top moulding 34 is further adapted with aperture 134 to accept lever 36. Rotary detent moulding 37 and top moulding 34 are injection moulded in a suitably resilient material such as polypropylene. Mask 31 is a stamped flat plastic component adapted with central slot 99 which accepts lever 36 and is further adapted with end notches 100 which define transverse displacement by their engagement upon guide bosses 107 of top moulding 34. Housing 32 is adapted with raised mounting points 101 such that mask 31 can move freely in the assembled state. Raised mounting points 101 are adapted with threaded holes to accept fixing screws 30. Printed circuit boards 38 are adapted with outer conductive tracks 126 which correspond to outer contacts 41, 49, 50 and 58, centre contacts 39, and solder terminals 42 through 48 and 51 through 57. Outer contacts 41, 49, 50 and 58 locate through slots 133 such that their inwardly biased ends 132 engage positively upon corresponding conductive tracks 126 by means of inwardly protruding contact points 135 and are secured in position by means of hollow rivets 40. Centre contacts 39 are attached to printed circuit boards 38 such that their inwardly biased ends 118 engage positively upon corresponding conductive tracks 126 by means of inwardly protruding contact points 135 and are secured by means of hollow rivets 40 thereby also creating common electrical connections terminated in solder terminals 45 and 54. Centre contacts 39 are further adapted with end flanges 119 which offer through slots 116 and engage selectively with side profiling 123 on rotary detent moulding 37. Centre and outer contacts are of a material customarily used in such applications such as Phosphor Bronze and may be treated with surface platings as may conductive tracks 126. Solder terminals 42 through 48 and 51 through 57 have integral rivet form such that they form positive electrical contact with conductors 126 when pressed. Printed circuit boards 38 are further adapted with central holes 117 which define an axial location for rotary detent moulding 37 by means of corresponding protrusions 124. Printed circuit boards 38 are further adapted with slots to accept claw-from 113 of pressed steel spacer 35. Claw-forms 113 secure both printed circuit boards 38 to spacer 35 thus capturing rotary detent moulding 37. Spacer 35 is further adapted with aperture 112 to accept lever 36 and rotary detent moulding 37. Spacer 35 is further adapted with tabs 115 which serve as ground terminations for subsequent wiring and also with tabs 114 which offer into corresponding slots 105 of housing 32 so as to define a transverse freedom of pivotal movement. Housing 32 is adapted with aperture 102 to accept lever 36. Aperture 102 limits the overall movement of lever 36 and may be adapted: with tongue 106 to enable the index progression shown in FIG. 13, or; without to enable the index progressions shown in FIG. 14 (thus adding position 72) and FIG. 15 (thus adding positions 71, 72 and 73). When rotary detent moulding 37 is orientated as shown in FIG. 17, steel ball 15 engages upon detent pattern 121, a five+five pattern, as exhibited in FIG. 13 and FIG. 15.

Figure 18:
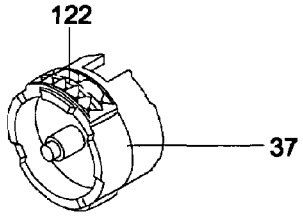
FIG. 18 is a perspective view showing an alternative orientation of one of the components of the embodiment 'B' compound selector switch.

FIG. 18 shows that rotary detent moulding 37 can be re-orientated so as to present detent pattern 122 which is a five+three pattern as exhibited in FIG. 14

Figure 19:
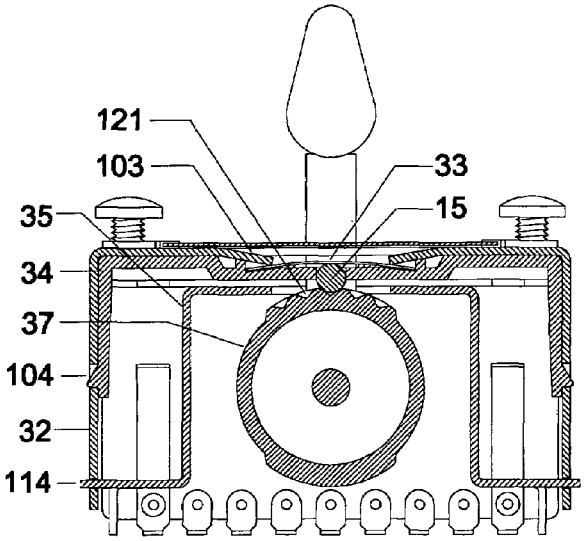
FIG. 19 is a sectional view taken on line 3—3 of the embodiment 'B' compound selector switch.

FIG. 19 demonstrates the manner in which flat spring 33 locates upon tabs 103 so as to apply pressure upon steel ball 15 which correspondingly engages upon detent pattern 121 of rotary detent moulding 37. The manner in which: top moulding 34 locks into housing 32 by means of cut-outs 104, and; the manner in which steel spacer 35 engages pivotally within housing 32 by means of tabs 114, are also demonstrated.

Figure 20:
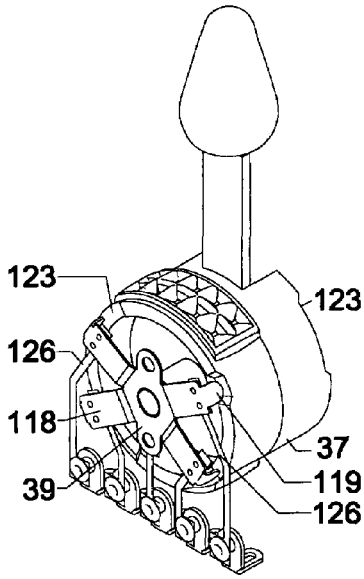
FIG. 20 is a perspective view of the embodiment 'B' compound selector switch where various components are omitted for clarity.

FIG. 20 demonstrates the relationship between centre contact 39 and rotary detent moulding 37 where the electrical contact between the inwardly biased ends 118 and corresponding conductive tracks 126 is selectively broken by means of engagement between end flanges 119 and the side profiling 123 of rotary detent moulding 37.

Figure 21:
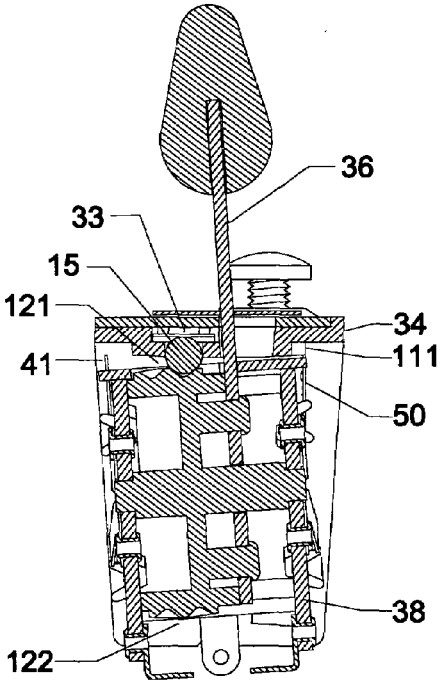
FIG. 21 is a sectional view taken on line 4—4 of the embodiment 'B' compound selector switch shown as in position 72.
Figure 22:
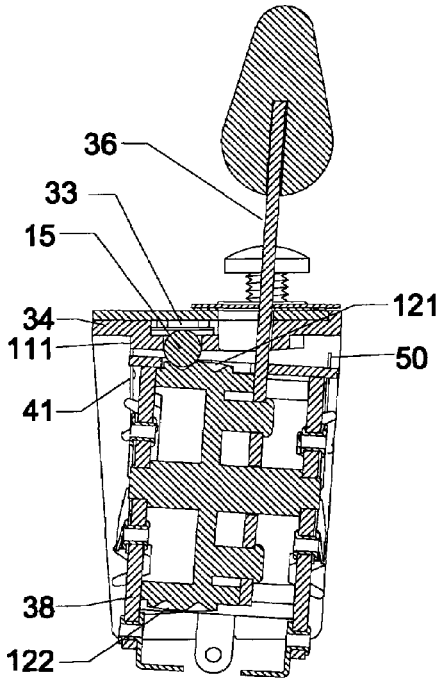
FIG. 22 is a sectional view taken on line 4—4 of the embodiment 'B' compound selector switch shown as in position 67.

FIG. 21 and FIG. 22 demonstrate the effect of transverse displacement of lever 36 where steel ball 15 engages upon parallel impressions of detent patterns 121 or 122 by means of pressure from flat spring 33 and where outer contacts 41 and 50 either engage upon the corresponding conductive tracks of printed circuit board 38 or are displaced by their engagement upon corresponding surface 111 of top moulding 34.

Figure 23:
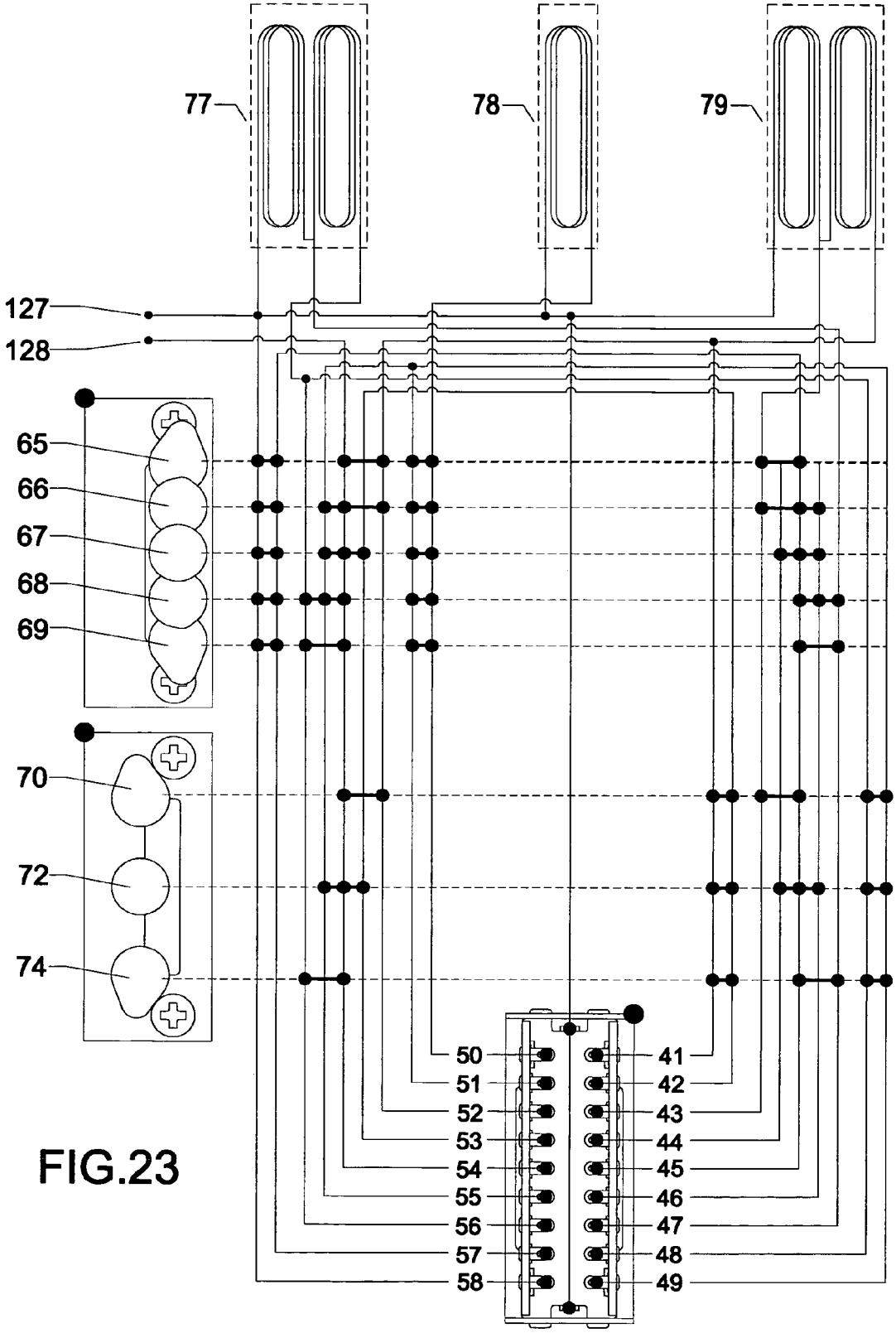
FIG. 23 is a schematic circuit diagram demonstrating a first application of the embodiment 'B' compound selector switch.
Figure 24:
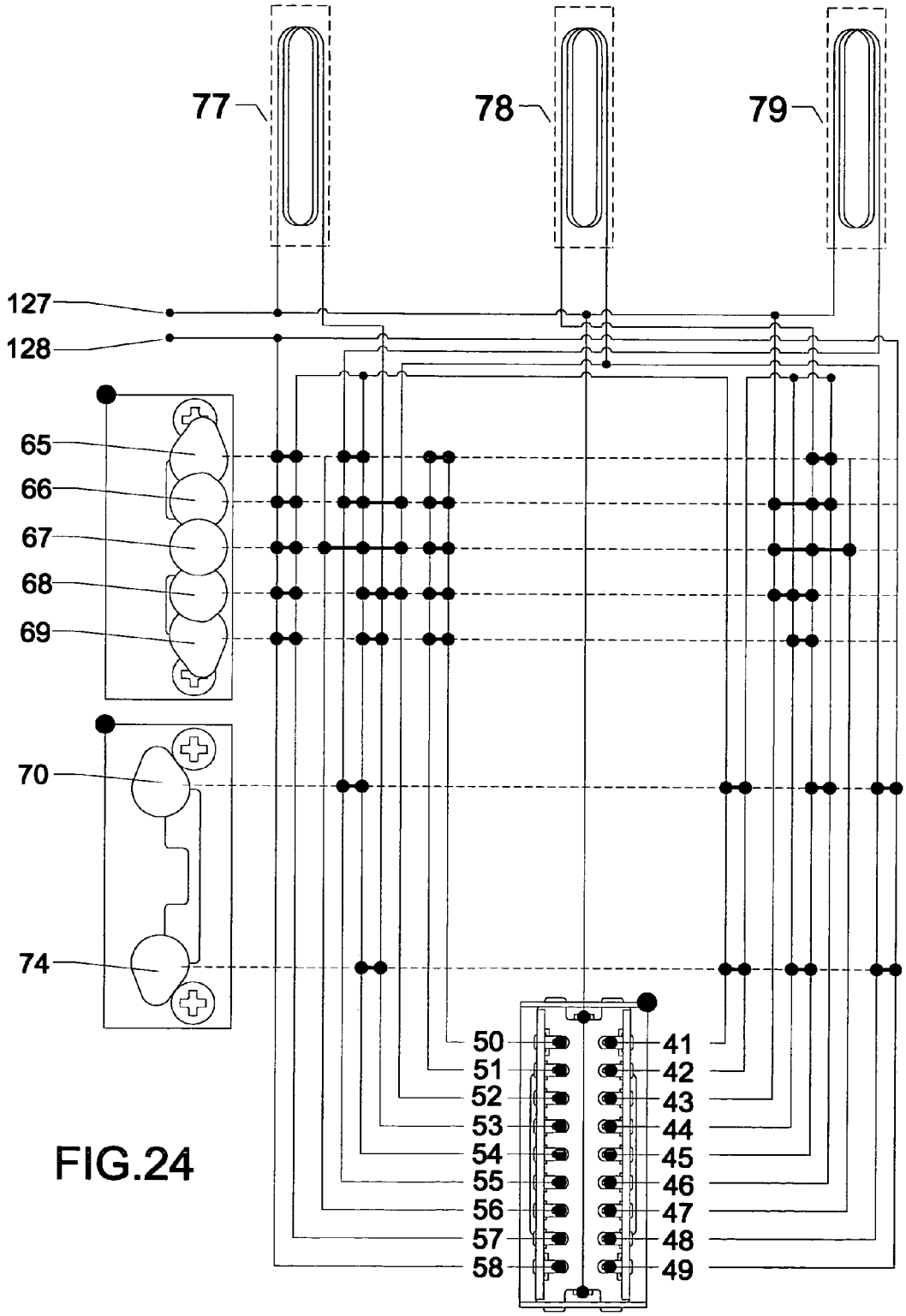
FIG. 24 is a schematic circuit diagram demonstrating a second application of the embodiment 'B' compound selector switch.

FIG. 23 and FIG. 24 illustrate the preferred electrical function, relative to each index position, of the embodiment 'B' compound selector switch in two separate examples. It should be understood that embodiment 'B' can also perform all of the applications relating to embodiment 'A' but in three pickup format, such applications typically being performed by the FIG. 15 model.

FIG. 23 illustrates the same index progression as shown in FIG. 14. The outputs of pickups 77, 78 and 79 are selectively connected to output pairing 127+128 in positions 65 through 69 at which settings the centre taps of pickups 77 and 79 are connected to ground at 127 by connections at 45+47 and 45+43 which effectively produces the five customary single-coil settings. In the transversely displaced state, the outputs of pickups 77 and 79 are further connected to 55 and 53 via connections at 48+49 and 41+42 respectively, middle pickup 78 is disconnected by 50+51 and the ground connection to the centre taps is disconnected by 57+58 which effectively produces the three customary dual-coil settings in positions 70, 72 and 74. This application provides guitarists with a truly comprehensive means of selecting the eight well known settings from a single switch element which appears to operate as a consistent integration of the familiar five-position switch with the familiar three-position switch. Contacts 44, 46, 52, 54 & 56 are shown here for reference.

FIG. 24 illustrates the same index progression as shown in FIG. 13. The outputs of pickups 77, 78 and 79 are selectively connected, via 57+58, to output pairing 127+128 which effectively produces the five customary single-coil settings in positions 65 through 69. Note that in these five settings, one of middle pickup 78's conductor's is connected to ground via 45+44+46+43, whereas it's other conductor selectively connects, via 52+54+57+58 to output 128. In the transversely displaced state, one of middle pickup 78's conductors is connected directly to output 128 via connections 48+49, whereas the other conductor is connected via 44+45+46+42+41 to: bridge pickup 77, via 53+54, in position 74, and; neck pickup 79, via 54+55, in position 70. This effectively produces: bridge pickup 77 in series with middle pickup 78 in position 74, and; neck pickup 79 in series with middle pickup 78 in position 70. This application provides guitarists with the conventional means of selecting the five familiar single-coil sounds but of also simulating the two familiar dual-coil sounds from a single switch element fitted to a three single-coil pickup guitar and represents a significant addition to the tonal spectrum of a guitar of this type. Contacts 47, 50, 51 & 56 are show here for reference.

It can be seen from the foregoing examples that the compound selector switch offers significant practical advantages in its capability of pickup configuration and concurrent control of associated switching functions.

Unlike the examples cited in the prior art, the compound selector switch requires the use of only one switch element, where index positions perform only one known function, where all settings are immediately recognisable, where the progression through index positions is familiar, where superfluous settings are avoided, and where negligible impact is made upon installation.

Because the compound selector switch is, to a large extent, only an integrated version of the switch elements already in use on many guitars it does not, of itself, represent a considerable cost premium. It is even foreseeable that manufacturers could derive assembly savings from fitting a single switch element in place of two or more.

The foregoing disclosure has been set forth merely to illustrate the invention and is not intended to be limiting in either application or embodiment. For example, the invention as manifested in embodiment 'A' or 'B' could be produced in a totally different construction, but providing an equivalent operation, or, the transverse motion could be further adapted to include more than two levels of parallel displacement, or, the longitudinal indexing progression could be adapted to provide two, four or six positions. Additional modifications, or variations, which occur to those skilled in the art may differ from those disclosed herein without departing from the spirit or scope of the inventive concept as defined by the appended claims and their equivalence.

What is claimed is:

1. An electrical switch apparatus for use on various types of stringed musical instruments such as electric guitars comprising:

an actuator means, said actuator means to enable manual selection of settings, said actuator means to have multi-directional freedom of travel, said actuator means to provide corresponding control over electrical contact means;

an electrical contact means, said electrical contact means to comprise a plurality of electrically isolated conductors wherein various pairs or groups of conductors alternate directly between absolute open circuit and absolute closed circuit states according to both specific longitudinal and specific transverse displacement of said actuator means and wherein said pairs or groups of electrical contacts either make direct contact with each other or are selectively abridged by another intermediary conductor of negligible electrical resistance;

a detent means, said detent means to impart a tactile indexing action upon the travel of said actuator means so as restrict the static orientation of said actuator means to a limited number of pre-defined positions which are clearly distinguishable and readily repeatable, said detent means to define indexing actions subject to both longitudinal and transverse displacement of said actuator means, said detent means to provide for stable positioning of said actuator means, said detent means to co-operate with said electrical contact means;

a housing means, said housing means to integrate said actuator means, said electrical contact means and said detent means;

wherein, said switch apparatus is an electrically passive device which does conduct electricity through said contacts but does not consume electricity in order to function;

wherein, said musical instrument further comprises a plurality of pickup coil conductors which are terminated upon said electrical contact means, and wherein, individual pickup coils will be rendered into a limited series of isolated circuits which are selected by manual displacement of the actuator means which will index between corresponding distinguishable positions in accordance with said detent means.

2. An electrical switch apparatus as in claim 1 wherein said detent means further comprises:

a ball resiliantly applied to an indented surface where each indentation serves to define a corresponding and distinct actuator position;

wherein, said indented surface comprises of substantially parallel rows of indentations where each row comprises an equal number of indentations.

3. An electrical switch apparatus as in claim 1, wherein said detent means further comprises:

a ball resiliantly applied to an indented surface where each indentation serves to define a corresponding and distinct actuator position;

wherein, said indented surface comprises of substantially parallel rows of indentations where rows comprise of unequal numbers of indentations.

4. An electrical switch apparatus as in claim 1, further comprising:

a gating means, said gating means to physically define the extents of travel of said actuator means whereby, in some positions, longitudinal and transverse actuator travel may be performed independantly but not collectively, said gating means to correspond with said electrical contact means and with said detent means.

5. An electrical switch apparatus as in claim 1, wherein said housing means further comprises:

a cylindrical collar, said cylindrical collar to be adapted to receive said actuator means axially therethrough while facilitating said longitudinal and transverse indexing motion, said cylindrical collar to include an external machine thread for the purpose of securing the entire switch apparatus in place, or;

screw fixing means, said screw fixing means to comprise of one or more holes or receptacles intended to receive a threaded fastener for the purpose of securing the entire switch apparatus in place.

6. An electrical switch apparatus as in claim 1, wherein said electrical contact means comprises five or more, electrical termination points upon which five or more, of said pickup coil conductors of said musical instrument may be electrically terminated.

* * * * *